US010779656B2

(12) United States Patent
Cothren

(10) Patent No.: US 10,779,656 B2
(45) Date of Patent: Sep. 22, 2020

(54) CLIMATE CONTROL BENCH

(71) Applicant: Brian Cothren, Fleming Island, FL (US)

(72) Inventor: Brian Cothren, Fleming Island, FL (US)

(73) Assignee: ATHLETIC RECOVERY ZONE, LLS, Jacksonville, FL (US)

( * ) Notice: Subject to any disclaimer, the term of this patent is extended or adjusted under 35 U.S.C. 154(b) by 0 days.

(21) Appl. No.: 16/460,428

(22) Filed: Jul. 2, 2019

(65) Prior Publication Data

US 2020/0000238 A1 Jan. 2, 2020

Related U.S. Application Data

(60) Provisional application No. 62/693,170, filed on Jul. 2, 2018.

(51) Int. Cl.

| | |
|---|---|
| ***A47C 7/74*** | (2006.01) |
| ***A47C 7/66*** | (2006.01) |
| ***A47C 11/00*** | (2006.01) |

(52) U.S. Cl.

CPC ..... *A47C 7/744* (2013.01); *A47C 7/748* (2013.01); *A47C 11/00* (2013.01)

(58) Field of Classification Search

CPC ..... A47C 7/748; A47C 11/005; A47C 11/00
See application file for complete search history.

(56) References Cited

U.S. PATENT DOCUMENTS

| | | | | |
|---|---|---|---|---|
| 2,147,564 | A * | 2/1939 | Vance | E04H 3/123 52/10 |
| 2,782,834 | A | 2/1957 | Vigo | |
| 3,097,505 | A | 7/1963 | Smith | |
| 3,745,305 | A | 7/1973 | Reed et al. | |
| 3,818,892 | A | 6/1974 | Von Kohorn | |
| 3,858,643 | A | 1/1975 | Reed | |
| 3,875,996 | A | 4/1975 | Von Kohorn et al. | |
| 3,948,246 | A | 4/1976 | Jenkins | |
| 4,134,615 | A | 1/1979 | Jenkins | |
| 4,307,701 | A | 12/1981 | Balon et al. | |
| 4,989,600 | A | 2/1991 | Collier | |
| 5,062,424 | A | 11/1991 | Hooker | |
| 5,450,894 | A | 9/1995 | Inoue et al. | |
| 5,459,887 | A | 10/1995 | Roman et al. | |
| 5,596,836 | A | 1/1997 | Benson | |
| 5,810,430 | A * | 9/1998 | Bryjak | E04H 3/126 297/139 |
| 6,435,608 | B1 | 8/2002 | Floyd, Jr. | |
| 6,580,060 | B1 | 6/2003 | Inman et al. | |
| 6,776,453 | B1 | 8/2004 | Floyd, Jr. | |
| 6,863,342 | B2 | 3/2005 | Floyd, Jr. | |
| 7,234,318 | B2 | 6/2007 | Grisler | |

(Continued)

*Primary Examiner* — Shin H Kim
(74) *Attorney, Agent, or Firm* — Thomas C. Saitta

(57) ABSTRACT

A climate control bench having air conditioning units delivering conditioned air through air vents in a housing, the bench having a channel return air intake returning conditioned air to the air conditioning units and an ambient air intake delivering non-conditioned ambient air to the air conditioning units, a removable cover for the channel return air intake and a removable cover for the ambient air intake, such either of the intakes may be open with the other closed, or such that both the intakes may be open.

12 Claims, 3 Drawing Sheets

(56) References Cited

U.S. PATENT DOCUMENTS

| | | | | |
|---|---|---|---|---|
| 7,267,403 | B2 * | 9/2007 | Conner | A47C 1/12 297/217.7 |
| D590,928 | S * | 4/2009 | Park | D23/314 |
| D613,393 | S * | 4/2010 | Dorsey | D23/397 |
| 7,905,546 | B2 * | 3/2011 | Conner | A47C 7/407 297/217.7 |
| 8,056,974 | B2 * | 11/2011 | Conner | A47C 1/12 297/217.7 |
| 9,435,554 | B2 * | 9/2016 | Cothren | F24F 5/0096 |
| D804,644 | S * | 12/2017 | Krob, Jr. | D23/397 |
| 2003/0107247 | A1 * | 6/2003 | Wills | A47C 11/00 297/217.1 |
| 2005/0200176 | A1 * | 9/2005 | Conner | A47C 7/407 297/248 |
| 2005/0250436 | A1 | 11/2005 | Nilsson | |
| 2006/0131936 | A1 * | 6/2006 | Suprina | A47C 1/12 297/232 |
| 2007/0193279 | A1 | 8/2007 | Yoneno et al. | |
| 2007/0236074 | A1 * | 10/2007 | Rodriquez, Jr. | A47C 7/021 297/452.41 |
| 2007/0296253 | A1 * | 12/2007 | Conner | A47C 1/12 297/239 |
| 2011/0100592 | A1 | 5/2011 | Johnson | |
| 2011/0163580 | A1 | 7/2011 | Lucas | |
| 2012/0112501 | A1 * | 5/2012 | Estes | A47C 11/00 297/180.12 |
| 2013/0026800 | A1 * | 1/2013 | Floyd, Jr. | A47C 7/748 297/180.13 |
| 2017/0095089 | A1 * | 4/2017 | Pratt | A47B 85/04 |
| 2018/0242748 | A1 * | 8/2018 | Lehoux | E04H 3/30 |
| 2020/0000238 | A1 * | 1/2020 | Cothren | A47C 11/00 |
| 2020/0157837 | A1 * | 5/2020 | Clark | E04H 3/10 |

* cited by examiner

CLIMATE CONTROL BENCH

BACKGROUND OF THE INVENTION

This application relates generally to the field of devices such as seats or benches used to provide localized cooling or heating for the users, and more particularly to such devices capable of cooling or heating personnel, such as athletes standing or sitting on the sidelines of sporting events, firefighters at the scene of a fire, workers in high or low temperature environments, participants in long running races, etc., and more particularly relates to such devices that provide cool or warm air from the interior of the bench.

Outdoor sporting events, such as football, soccer, tract, etc., are often contested in weather conditions of extreme high or low temperatures. The athletes in these events, particularly when standing or sitting on the sidelines during a contest or after participation, can become overheated or badly chilled. Likewise, workers toiling indoors or outdoors under extreme temperature conditions, in particular when heavy safety or protective gear must be worn, are susceptible to overheating (e.g., metal refinery workers) or hyperthermia (e.g., cold storage workers).

A climate control bench is presented in my U.S. Pat. No. 9,435,554, which issued on Sep. 6, 2016. The bench disclosed in the '554 patent is an outdoor heating and cooling seating system creating an open temperature-controlled zone for personnel, the system comprising a bench device; an outwardly extending seat member disposed at a raised elevation on the bench device; an outwardly extending deck member disposed at a base of the bench device, the deck member comprising an upper support surface adapted to support personnel standing on the deck member; the deck member disposed below and extending farther outward than the seat member such that personnel may stand on the deck member or sit on the seat member; an air conditioning means for producing and delivering conditioned air through an air delivery conduit; a first air outlet disposed within the deck member, the first air outlet operably connected to the air delivery conduit whereby the conditioned air is expelled in an upward direction through the upper support surface around and past the seat member; a second air outlet disposed above the seat member, the second air outlet operably connected to the air delivery conduit whereby the conditioned air is expelled in a forward direction over the seat member; and a first air intake disposed between the first air outlet and the second air outlet, the first air intake configured to retrieve and return a first portion of the conditioned air expelled from the first air outlet and the second air outlet to the air conditioning means such that the first portion of the conditioned air is reconditioned by the air conditioning means, re-delivered through the air delivery conduit and expelled through the first and second air outlets.

This design has proven to be effective for climate control by creating a zone of recycled cooler air in high temperature environments and creating a zone of recycled warmer air in low temperature environments. It is an object of this invention to provide an improved climate control bench for supplying recycled cooled or heated air from the interior of the bench to a localized zone in a controlled manner such that personnel utilizing the bench will be warmed or cooled in an efficient manner. It is an object to provide such a bench wherein air intake may occur from within the open temperature-controlled zone, effectively recycling a significant portion of the conditioned air, or from the ambient environment away from the open temperature-controlled zone, or from both sources simultaneously, depending on the external conditions encountered during use.

SUMMARY OF THE INVENTION

The invention in various embodiments comprises in general a climate control bench, such as for example an outdoor sports bench, the bench having a housing or enclosure, a lower seating deck and an upper seating deck, a backrest panel and a lower panel, and a plurality of air vents for dispersing conditioned air from at least one air conditioning unit, the air conditioning unit able to provide heated or cooled air depending on the need. The conditioned air is delivered through a plurality of air vents or outlets, the air vents being located in the lower panel, the lower seating deck, the backrest, both lower and upper, and/or the upper seating deck. A lower plenum delivers conditioned air to the lower panel air vents and the lower seating deck air vents. An upper plenum delivers air to the backrest lower air vents, backrest upper air vents, and upper seating deck air vents. A single air conditioning unit situated within the housing delivers air to both the upper and lower plenums, or multiple air conditioning units may be provided, in which case one air conditioning unit delivers air to the lower plenum and another air conditioning unit delivers conditioned air to the upper plenum.

An apertured channel return intake member extends along the length of the bench between the lower seating deck and the backrest, such that during operation a significant portion of the conditioned air delivered through the vents is returned to the air conditioning unit for re-conditioning. The climate control bench creates an open temperature-controlled zone of conditioned air. A removable cover is provided to seal off the channel return intake when it is desirable to preclude recycling of the conditioned air, in which case the one or more air conditioning unit conditions ambient air drawn through an ambient air intake opening in the housing, i.e., air not within the open temperature-controlled zone. The ambient air intake is sealed with a removable ambient air intake cover when recycled air is being conditioned, the ambient air intake cover being removed when the channel return intake is closed by the channel return intake cover. Both the channel return intake cover and the ambient air intake cover may be removed at the same time if needed such that air is drawn through the channel return intake and the ambient air intake. In this manner, the climate control bench may utilize only ambient air, only air recycled from the temperature-controlled zone, or air from both sources.

In alternative summary, the invention is a climate control bench comprising a housing containing one or more air conditioning units conditioning air for dispersal from said housing; a lower seating deck; a lower panel member positioned beneath said lower seating deck; an upper seating deck; a backrest panel positioned between said lower seating deck and said upper seating deck; air vents positioned in and dispersing conditioned air through said lower panel member, said backrest panel and said upper seating deck; a channel return air intake positioned between said lower seating deck and said upper seating deck, said channel return air intake providing a passage for said one or more air conditioning units to draw conditioned air through said channel return air intake for recycling through said one or more air conditioning units; an ambient air intake positioned on said housing and open to the ambient, said ambient air intake providing a passage for said one or more air conditioning units to draw ambient air through said ambient air intake; a removable channel cover structured such that said channel return air intake may be closed by said removable channel cover; and a removable ambient air cover structured such that ambient air intake may be closed by said removable channel cover; whereby said climate control bench may be configured with said channel cover removed and said ambient air cover positioned to close said ambient air intake, may be configured with said ambient air intake cover removed and said channel cover positioned to close said channel air intake, or with said channel cover and said ambient air intake cover removed. Furthermore, such a bench further comprising a return chamber located within said housing, and wherein said channel return air intake and said ambient air intake open to said return chamber; said lower seating deck comprising a lower deck seating face, said climate control bench further comprising air vents positioned in said lower deck seating face; wherein said air vents positioned in said upper seating deck are linear diffusers; wherein said air vents positioned in said back rest panel are linear diffusers; further comprising a lower plenum and an upper plenum, said upper plenum receiving conditioned air from said one or more air conditioning units and delivering the conditioned air to said air vents positioned in said upper seating deck and said backrest panel, and said lower plenum receiving conditioned air from said one or more air conditioning units and delivering the conditioned air to said air vents positioned in lower panel member; and/or said one or more air conditioner units comprising one air conditioner unit delivering conditioned air to said lower plenum and another air conditioner unit delivering conditioned air to said upper plenum.

Alternatively still, the invention is a climate control bench defining an open temperature-controlled zone, the climate control bench comprising: a housing containing one or more air conditioning units conditioning air for dispersal from said housing; said housing comprising the combination of a lower seating deck, a lower panel member positioned beneath said lower seating deck, an upper seating deck, and a backrest panel positioned between said lower seating deck and said upper seating deck, and a return chamber; air vents positioned on and dispersing conditioned air through said lower panel member, said back rest panel and said upper seating deck; an elongated channel return air intake positioned between said lower seating deck and said upper seating deck, said channel return air intake providing a passage for said one or more air conditioning units to draw conditioned air through said channel return air intake for recycling through said one or more air conditioning units; an ambient air intake positioned on said housing and open to the ambient, said ambient air intake providing a passage for said one or more air conditioning units to draw ambient air through said ambient air intake; a removable channel cover structured such that said channel return air intake may be closed by positioning said removable channel cover on said channel return cover; and a removable ambient air cover structured such that ambient air intake may be closed by positioning said removable channel cover on said ambient air intake; such that said climate control bench may be configured with said channel cover removed from said channel return air intake and said ambient air cover positioned on said ambient air intake, may be configured with said ambient air intake cover removed from said ambient air intake and said channel cover positioned on said channel air intake, or with said channel cover removed from said channel return air intake and said ambient air intake cover removed from said ambient air intake. Furthermore, such bench said lower seating deck comprising a lower deck seating face, said climate control bench further comprising air vents positioned in said lower deck seating face; wherein said air vents positioned in said upper seating deck are linear diffusers; wherein said air vents positioned in said back rest panel are linear diffusers; further comprising a lower plenum and an upper plenum, said upper plenum receiving conditioned air from said one or more air conditioning units and delivering the conditioned air to said air vents positioned in said upper seating deck and said backrest panel, and said lower plenum receiving conditioned air from said one or more air conditioning units and delivering the conditioned air to said air vents positioned in lower panel member; and/or said one or more air conditioner units comprising one air conditioner unit delivering conditioned air to said lower plenum and another air conditioner unit delivering conditioned air to said upper plenum.

DETAILED DESCRIPTION OF THE INVENTION

Figure 1:
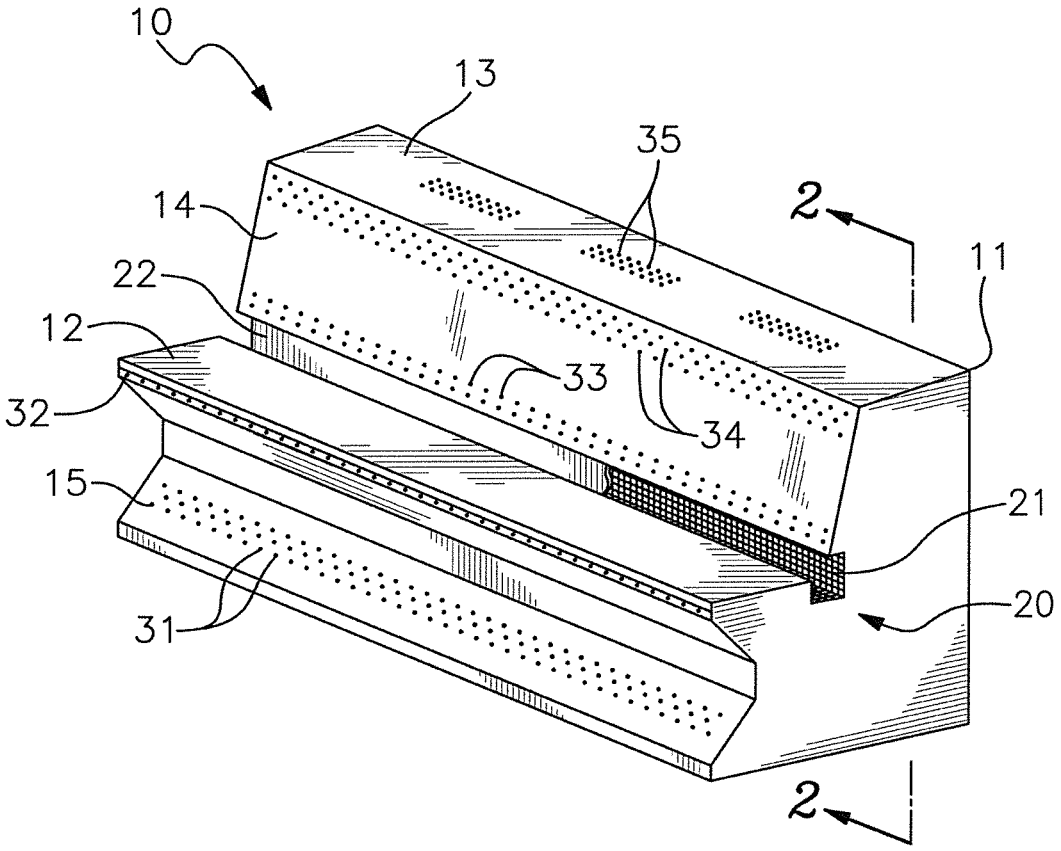
FIG. 1 is a front perspective view of an embodiment of the climate control bench having a single air conditioning unit delivering conditioned air to both the lower and the upper plenums, the bench configured so as to draw air for conditioning only from the open temperature-controlled zone, the ambient air intake being covered.

In general, the invention in various embodiments comprises in general a climate control bench 10, such as for example a sports bench, the bench 10 having an elongated housing or enclosure 11, a lower seating deck 12 having a face 19, an upper seating deck 13, a backrest panel member 14, a lower panel member 15, a rear panel member 16, a bottom 17, ends 18, and a plurality of air vents for dispersing conditioned, i.e., cooled or heated, air from at least one air conditioning unit 30 retained within the housing 11. The bench 10 is preferably composed of an aluminum or similar metal, and the housing 11 defines a return chamber 40, such that air within the return chamber 40 is drawn into the air conditioning unit 30 through the air conditioner intake 44. The backrest panel 14 and the lower panel 15 are preferably angled from vertical—the backrest panel 14 being angled to provide comfortable support to users seated on the horizontally disposed lower seating deck 12, and the lower panel 15 being angled out of vertical to face above horizontal so as to disperse conditioned air at an upward angle.

Figure 2:
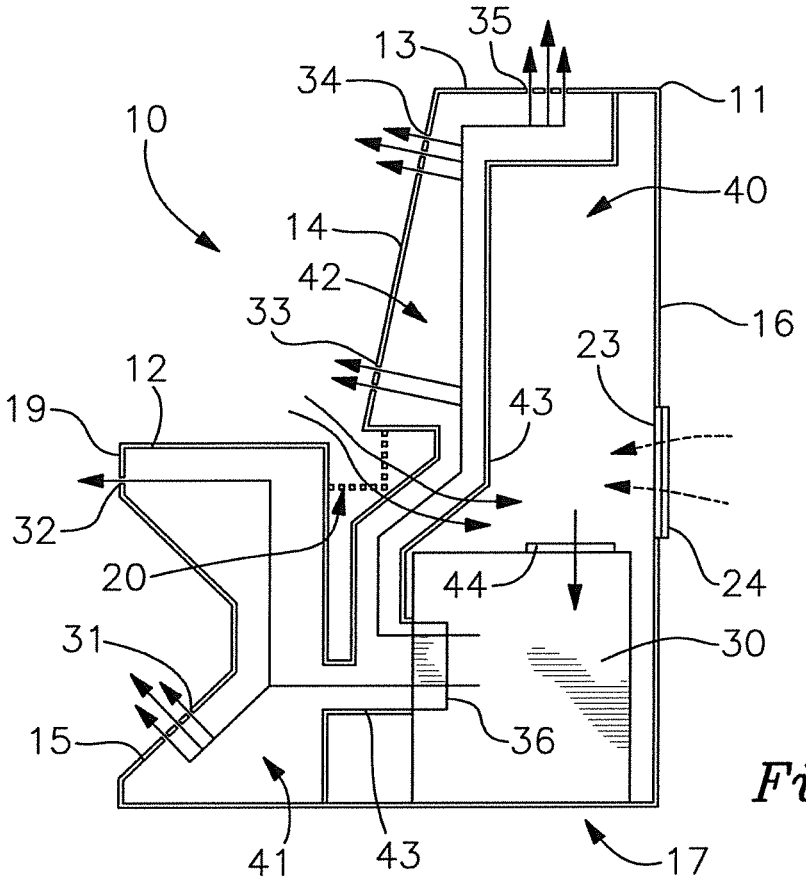
FIG. 2 is an exposed end view of the bench shown in FIG. 1.

A first embodiment of the climate control bench 10 is illustrated in FIGS. 1 and 2, wherein a single air conditioning unit 30 delivers conditioned air to a lower plenum 41 and an upper plenum 42. The conditioned air is delivered from the air conditioning unit 30 by a fan or blower unit 36 through ducts 43 into the lower plenum 41 and the upper plenum 42, whereby conditioned air is dispersed from the housing 11 through a plurality of air vents or outlets. The lower plenum 41 and upper plenum 42 are preferably separate members not sharing an open interior, the air flow from the air conditioning unit 30 being directed through a bifurcated duct 43 for better control of air flow into the lower plenum 41 and upper plenum 42. The air vents comprise one or more, and preferably all of, lower panel air vents 31, lower seating deck air vents 32, backrest lower air vents 33, backrest upper air vents 34, and upper seating deck air vents 35, and may be configured as a large number of relatively small apertures as shown in FIGS. 1 and 2, mesh or screen members (not shown), sets of linear diffusers or louvers 53/54/55 as shown in FIGS. 3 and 4, or any other configurations or structures that allow passage of the conditioned air.

The lower plenum 41 delivers conditioned air to the lower panel air vents 31 positioned in the lower panel member 15 and to the lower seating deck air vents 32, which are positioned in the forward face 19 of the lower seating deck 12. Because the lower panel member 15 is angled out of vertical, conditioned air forcefully dispersed through the lower panel member 15 is directed at an upward angle. Conditioned air dispersed through the lower seating deck face 19 is directed horizontally outward. The upper plenum 42 delivers air to the backrest lower air vents 33, backrest upper air vents 34, and upper seating deck air vents 35. The backrest lower air vents 33 are positioned near the bottom of the backrest panel 14 and the backrest upper air vents 34 are positioned near the top of the backrest panel 14, preferably, although they may be more widely dispersed across the backrest panel 14. As such, the backrest lower air vents 33 and the backrest upper air vents 34 deliver the conditioned air at a slight upper angle due to the angled orientation of the backrest panel 14. The upper seating deck air vents 35 disperse the conditioned air vertically through the upper seating deck 13, which is horizontally oriented so that personnel can sit atop the upper seating deck 13 with their feet on the lower seating deck 12. The upper seating deck 13 also provides a support surface on which helmets, hats, gloves, etc., may be placed for cooling or heating by the conditioned air coming from the upper seating deck air vents 35.

Figure 4:
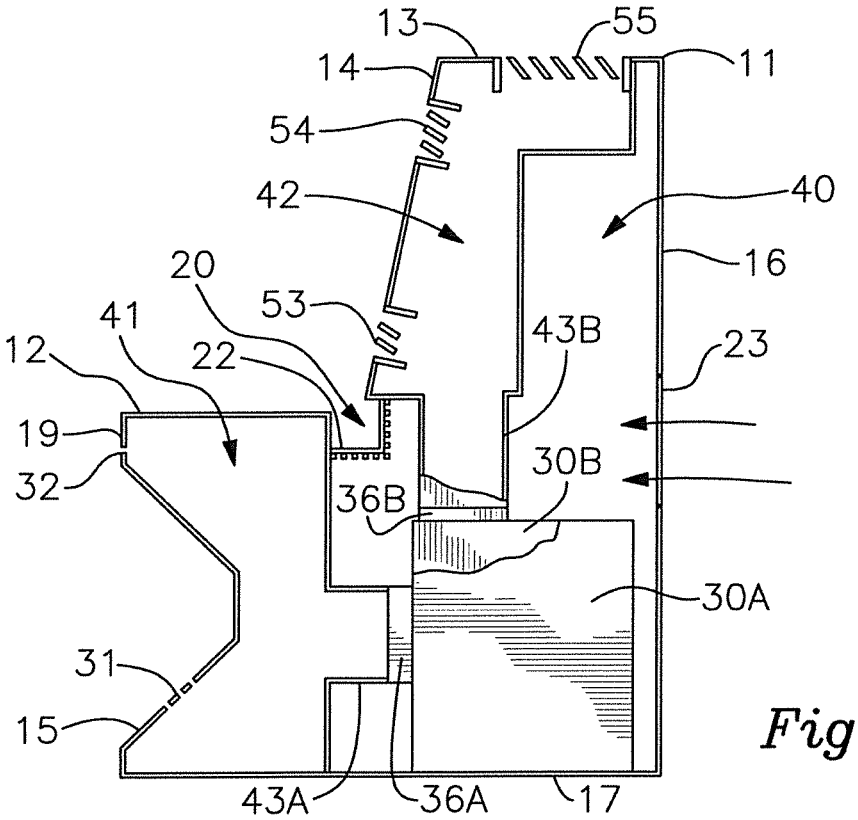
FIG. 4 is an exposed end view of the bench shown in FIG. 3.
Figure 3:
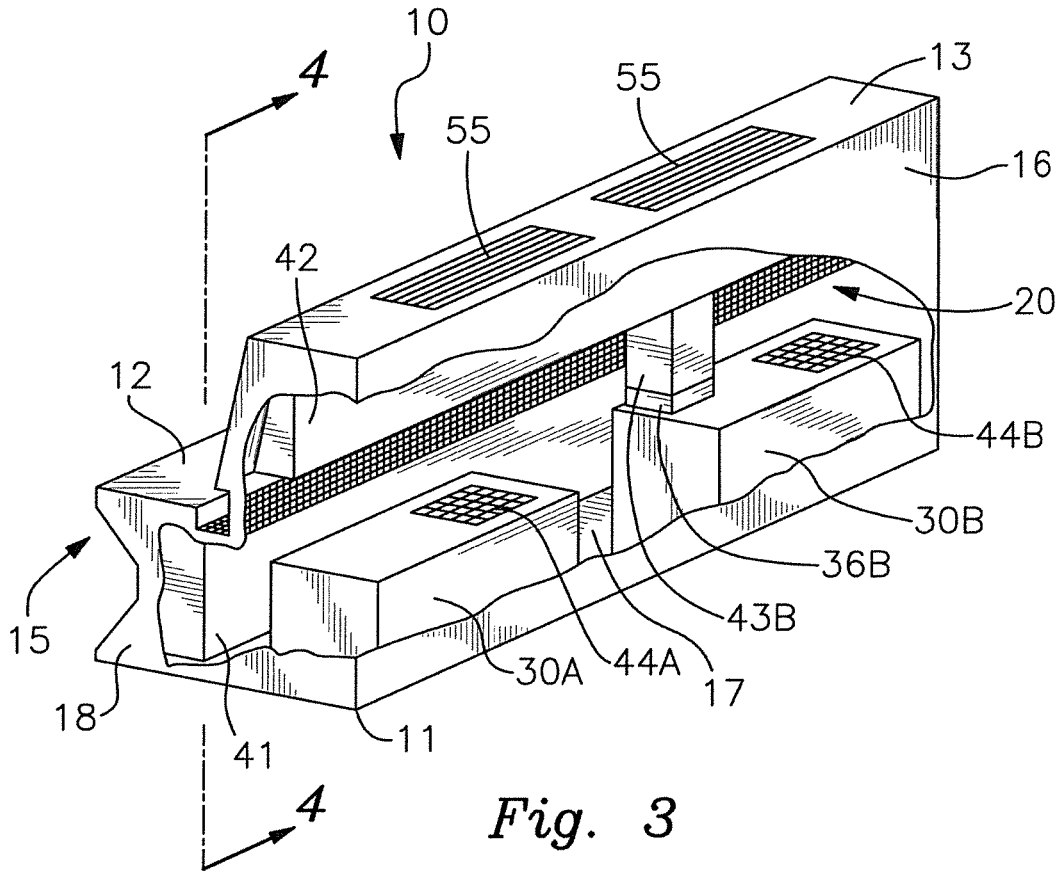
FIG. 3 is a partially exposed, rear perspective view of an alternative embodiment of the bench having two air conditioning units, each air conditioning unit being a dedicated unit, such that one air conditioning unit delivers conditioned air to the lower plenum and the other air conditioning unit delivers conditioned air to the upper plenum, the bench configured so as to draw air for conditioning only from the ambient air intake, the channel return intake being covered.

As shown in FIGS. 3 and 4, some or all of the air vents may consist of elongated linear diffusers 53/54/55, such as for example louvers, which act to direct the conditioned air in a controlled direction and flow. The linear diffusers may be fixed or may be angularly adjustable. For example, the bench 10 may comprise backrest lower linear diffusers 53, backrest upper linear diffusers 54 and/or upper seating deck linear diffusers 55. The lower panel air vents 31 and lower seating deck air vents 32 may also be provided as linear diffusers.

An elongated, apertured, channel return intake member 20 having intake apertures 21 extends along the length of the bench 10 between the lower seating deck 12 and the backrest panel 14. The channel return intake member 20 may be formed from a screen, grid or mesh material, or may be formed as a perforated member. The channel return intake 20 is the primary source of return air for the air conditioning unit 30 during air recycling, the air being drawn through the channel return intake 20 and into the return chamber 40 by suction. In this manner a significant portion of the conditioned air dispersed from the bench 10 is recycled to the air conditioning unit 30, such that less energy is required to heat or cool the previously heated or cooled air as opposed to providing only ambient air to the air conditioning unit 30.

As used herein, the term "ambient air" shall be taken to mean air that has not been previously conditioned by the air conditioning units 30, but shall exclude that portion of ambient air that is mixed with the conditioned air that is drawn back into the air conditioning units 30 through the channel return intake 20, as explained in detail below. Likewise, the term "ambient air" shall not refer herein to the initial air drawn through the channel return intake 20 at start up. Thus, "ambient air" shall refer only to air drawn through the ambient air intake 23

Although the use of recycled air is one of the primary benefits of the bench design, it may be desirable or necessary in certain circumstances to provide alternative structures or designs for air intake. For example, if the bench 10 is fully occupied a large portion of the channel return intake 20 is essentially blocked and there may be an insufficient amount of air drawn into return chamber 40 for conditioning by the air conditioning unit 30. Additionally, in very cold environments it may be desirable to reduce or eliminate return air flow through the channel return intake 20 so as not to draw cold ambient air toward the bench 10. The bench 10 therefore further comprises an ambient air intake opening 23, shown herein as a rear air intake opening, configured or comprising a plurality of apertures, a screen, mesh or the like. A removable ambient air intake cover 24 is provided to close or seal the ambient air intake opening 23 as needed. The ambient air intake 23 is preferably located in the rear panel member 16 of the housing 11. In the event it is desired to provide an additional air intake in combination with the channel return intake 20, such as when there is insufficient air being returned through the channel return intake 20, or if it is desirable to close off the channel return intake 20 completely, the ambient air intake 23 serves as an alternative or complementary source of air for the air conditioner unit 30.

A removable channel cover 22, shown as being L-shaped cross-section, is provided to seal off the channel return intake 20, the channel cover 22 preferably being configured so as to generally mate with the channel return intake 20 to block the air intake apertures 21 without interfering with personnel seated on the lower seating deck 12. The channel cover 22 is usually removed, or displaced into a non-sealing position relative to the channel return intake 20, to recycle the conditioned air, especially when the bench 10 is producing cooled air, such that the air being drawn into the return chamber 40 and the air conditioning unit 30 is pulled from the temperature controlled zone in front of the bench 10 where previously conditioned air has been dispelled. If necessary the ambient air intake cover 24 may be removed as well to provide a greater volume of air into the return chamber 40. In certain circumstances, such as in very cold ambient environments when heated air is being produced, the channel cover 22 is positioned to seal the channel return intake member 20 and the ambient air intake cover 24 is removed such that ambient air is drawn only through the ambient air intake 23 and no conditioned air is recycled. The channel cover 22 may be completely removable or may be hingedly attached, and different cross-sectional configurations are possible.

The upper surface of the housing 11 must be structurally rigid, as it is configured to provide a horizontal upper seating deck 13, as it has been observed that users often prefer to be seated at a higher elevation to provide better sight lines, such as for example football players watching play on the field. The upper seating deck air vents 35 will provide conditioned air to anyone sitting on the top of the housing 11, and may also be used to heat or cool helmets, hats or the like placed onto the upper seating deck air vents 35.

The bench 10 may comprise two or more air conditioning units 30, as shown in FIGS. 3 and 4. In this embodiment one of the air conditioning units 30A is preferably dedicated to the lower plenum 41, such that air is drawn from the return chamber 40 through air conditioning intake 44A, conditioned by the air conditioning unit 30A, and blown by fan 36A into horizontal duct 43A and lower plenum 41 for dispersal through lower panel air vents 31 and lower seating deck air vents 32. Another air conditioning unit 30 B is dedicated to the upper plenum 42, such that air is drawn from the return chamber 40 through air conditioning intake 44B, conditioned by the air conditioning unit 30B, and blown by fan 36B into vertical duct 43B and upper plenum 42 for dispersal backrest panel lower air vents 33 or linear dispersers 53, upper backrest panel air vents 34 or linear dispersers 54, and upper seating deck air vents 35 or linear dispersers 55.

It is understood that equivalents substitutions for certain elements set forth above may be obvious to those of ordinary skill in the art, and therefore the true scope and definition of the invention is to be as set forth in the following claims.

I claim:

1. A climate control bench comprising:

a housing containing one or more air conditioning units conditioning air for dispersal from said housing;

a lower seating deck;

a lower panel member positioned beneath said lower seating deck;

an upper seating deck;

a backrest panel positioned between said lower seating deck and said upper seating deck;

air vents positioned in and dispersing conditioned air through said lower panel member, said backrest panel and said upper seating deck;

a channel return air intake positioned between said lower seating deck and said upper seating deck, said channel return air intake providing a passage for said one or more air conditioning units to draw conditioned air through said channel return air intake for recycling through said one or more air conditioning units;

an ambient air intake positioned on said housing and open to the ambient, said ambient air intake providing a passage for said one or more air conditioning units to draw ambient air through said ambient air intake;

a removable channel cover structured such that said channel return air intake may be closed by said removable channel cover; and a removable ambient air cover structured such that ambient air intake may be closed by said removable channel cover;

whereby said climate control bench may be configured with said channel cover removed and said ambient air cover positioned to close said ambient air intake, may be configured with said ambient air intake cover removed and said channel cover positioned to close said channel air intake, or with said channel cover and said ambient air intake cover removed;

said climate control bench further comprising a return chamber located within said housing, wherein said channel return air intake and said ambient air intake open to said return chamber.

2. The climate control bench of claim 1, said lower seating deck comprising a lower deck seating face, said climate control bench further comprising air vents positioned in said lower deck seating face.

3. The climate control bench of claim 1, wherein said air vents positioned in said upper seating deck are linear diffusers.

4. The climate control bench of claim 3, wherein said air vents positioned in said back rest panel are linear diffusers.

5. A climate control bench comprising:

a housing containing one or more air conditioning units conditioning air for dispersal from said housing;

a lower seating deck;

a lower panel member positioned beneath said lower seating deck;

an upper seating deck;

a backrest panel positioned between said lower seating deck and said upper seating deck;

air vents positioned in and dispersing conditioned air through said lower panel member, said backrest panel and said upper seating deck;

a channel return air intake positioned between said lower seating deck and said upper seating deck, said channel return air intake providing a passage for said one or more air conditioning units to draw conditioned air through said channel return air intake for recycling through said one or more air conditioning units;

an ambient air intake positioned on said housing and open to the ambient, said ambient air intake providing a passage for said one or more air conditioning units to draw ambient air through said ambient air intake;

a removable channel cover structured such that said channel return air intake may be closed by said removable channel cover; and a removable ambient air cover structured such that ambient air intake may be closed by said removable channel cover;

whereby said climate control bench may be configured with said channel cover removed and said ambient air cover positioned to close said ambient air intake, may be configured with said ambient air intake cover removed and said channel cover positioned to close said channel air intake, or with said channel cover and said ambient air intake cover removed;

said climate control bench further comprising a lower plenum and an upper plenum, said upper plenum receiving conditioned air from said one or more air conditioning units and delivering the conditioned air to said air vents positioned in said upper seating deck and said backrest panel, and said lower plenum receiving conditioned air from said one or more air conditioning units and delivering the conditioned air to said air vents positioned in lower panel member.

6. The climate control bench of claim 5, said one or more air conditioner units comprising one air conditioner unit delivering conditioned air to said lower plenum and another air conditioner unit delivering conditioned air to said upper plenum.

7. A climate control bench defining an open temperature-controlled zone, the climate control bench comprising:

a housing containing one or more air conditioning units conditioning air for dispersal from said housing;

said housing comprising the combination of a lower seating deck, a lower panel member positioned beneath said lower seating deck, an upper seating deck, and a backrest panel positioned between said lower seating deck and said upper seating deck, and a return chamber;

air vents positioned on and dispersing conditioned air through said lower panel member, said back rest panel and said upper seating deck;

an elongated channel return air intake positioned between said lower seating deck and said upper seating deck, said channel return air intake providing a passage for said one or more air conditioning units to draw conditioned air through said channel return air intake for recycling through said one or more air conditioning units;

an ambient air intake positioned on said housing and open to the ambient, said ambient air intake providing a passage for said one or more air conditioning units to draw ambient air through said ambient air intake;

a removable channel cover structured such that said channel return air intake may be closed by positioning said removable channel cover on said channel return cover; and a removable ambient air cover structured such that ambient air intake may be closed by positioning said removable channel cover on said ambient air intake;

such that said climate control bench may be configured with said channel cover removed from said channel return air intake and said ambient air cover positioned on said ambient air intake, may be configured with said ambient air intake cover removed from said ambient air intake and said channel cover positioned on said channel air intake, or with said channel cover removed from said channel return air intake and said ambient air intake cover removed from said ambient air intake.

8. The climate control bench of claim 7, said lower seating deck comprising a lower deck seating face, said climate control bench further comprising air vents positioned in said lower deck seating face.

9. The climate control bench of claim 7, wherein said air vents positioned in said upper seating deck are linear diffusers.

10. The climate control bench of claim 9, wherein said air vents positioned in said back rest panel are linear diffusers.

11. The climate control bench of claim 7, further comprising a lower plenum and an upper plenum, said upper plenum receiving conditioned air from said one or more air conditioning units and delivering the conditioned air to said air vents positioned in said upper seating deck and said backrest panel, and said lower plenum receiving conditioned air from said one or more air conditioning units and delivering the conditioned air to said air vents positioned in lower panel member.

12. The climate control bench of claim 11, said one or more air conditioner units comprising one air conditioner unit delivering conditioned air to said lower plenum and another air conditioner unit delivering conditioned air to said upper plenum.

* * * * *